US009616270B2

(12) United States Patent
Towley et al.

(10) Patent No.: US 9,616,270 B2
(45) Date of Patent: Apr. 11, 2017

(54) SELECTORIZED DUMBBELL HAVING KETTLEBELL STYLE HANDLE

(71) Applicants: Mattson K. Towley, Owatonna, MN (US); Carl K. Towley, III, Sebastian, FL (US)

(72) Inventors: Mattson K. Towley, Owatonna, MN (US); Carl K. Towley, III, Sebastian, FL (US)

(73) Assignee: PowerBlock Holdings, Inc., Owatonna, MN (US)

( * ) Notice: Subject to any disclaimer, the term of this patent is extended or adjusted under 35 U.S.C. 154(b) by 0 days.

(21) Appl. No.: 14/157,253

(22) Filed: Jan. 16, 2014

(65) Prior Publication Data

US 2015/0196792 A1 Jul. 16, 2015

(51) Int. Cl.

*A63B 21/075* (2006.01)
*A63B 21/072* (2006.01)
*A63B 21/00* (2006.01)

(52) U.S. Cl.

CPC ..... *A63B 21/075* (2013.01); *A63B 21/00065* (2013.01); *A63B 21/072* (2013.01); *A63B 21/4035* (2015.10)

(58) Field of Classification Search

CPC .... A63B 2021/0623; A63B 2021/0722; A63B 21/00065; A63B 21/06; A63B 21/0608; A63B 21/072–21/075; A63B 21/1469; A63B 21/1476; A63B 21/4033–21/4034

See application file for complete search history.

(56) References Cited

U.S. PATENT DOCUMENTS

| | | | | |
|---|---|---|---|---|
| 5,769,762 | A | 6/1998 | Towley, III | |
| 7,052,445 | B2 | 5/2006 | Ekhaus | |
| 7,153,244 | B2 | 12/2006 | Towley, III | |
| 7,491,157 | B1 * | 2/2009 | Lin | A63B 21/0728 482/107 |
| 7,563,208 | B1 | 7/2009 | Chen | |
| 7,981,013 | B2 | 7/2011 | Krull | |
| 8,012,069 | B2 | 9/2011 | Towley, III | |
| 8,021,282 | B2 | 9/2011 | Polevoy et al. | |
| 2003/0232704 | A1 * | 12/2003 | Bowman et al. | 482/107 |

(Continued)

FOREIGN PATENT DOCUMENTS

JP 2007021123 2/2007

OTHER PUBLICATIONS

KIPO, PCT Written Opinion & Search Report, Apr. 6, 2015.

*Primary Examiner* — Loan H Thanh
*Assistant Examiner* — Jennifer M Deichl
(74) *Attorney, Agent, or Firm* — James W. Miller

(57) ABSTRACT

A selectorized dumbbell comprises a handle assembly that comprises a generally triangularly shaped handle housing having an upwardly extending loop style handle in the manner of a kettlebell handle. The handle housing has angled side walls that provide surfaces on which the user's forearm can rest when doing certain exercises. The handle housing is hollow inside. A set of generally triangularly shaped add-on weights of progressively decreasing size can be nested inside one another with the set of weights being nested inside the handle housing. A repositionable connecting pin can be placed into different positions on the handle housing to selectively couple a desired number of the add-on weights to the handle housing.

5 Claims, 8 Drawing Sheets

(56) References Cited

U.S. PATENT DOCUMENTS

| | | | | |
|---|---|---|---|---|
| 2008/0081744 | A1 | 4/2008 | Gormley | |
| 2009/0062085 | A1* | 3/2009 | Polevoy et al. | 482/93 |
| 2011/0111929 | A1 | 5/2011 | Allison et al. | |
| 2011/0306475 | A1* | 12/2011 | Caswell et al. | 482/93 |
| 2012/0231936 | A1 | 9/2012 | Krull | |
| 2013/0040789 | A1* | 2/2013 | Kessler | 482/108 |

* cited by examiner

SELECTORIZED DUMBBELL HAVING KETTLEBELL STYLE HANDLE

TECHNICAL FIELD

This invention relates to hand weights, known as dumbbells, which are used for exercise and/or weight training purposes. More particularly, this invention relates to a selectorized dumbbell that permits the user to selectively attach or couple different numbers of weights to the dumbbell handle from among a set or series of nested weights to vary the exercise mass of the dumbbell.

BACKGROUND OF THE INVENTION

Adjustable weight dumbbells are known which are referred to as selectorized dumbbells, such as that shown in U.S. Pat. No. 5,637,034, which is owned by the assignee of this invention. In such a dumbbell, the handle has a pair of planar ends that are spaced apart from one another but are rigidly joined to one another at least by a central hand grip that extends between the ends and is affixed thereto. Some type of movable selector is used which coacts with the handle and with a desired number of weight plates disposed in left and right stacks of nested weight plates. When the selector is moved between different positions relative to the handle, different numbers of weight plates are coupled to the left and right ends of the handle to adjust the exercise mass of the selectorized dumbbell.

In the selectorized dumbbell described above, the hand grip of the handle is located between the top and bottom edges of any weight plates coupled to the ends of the handle such that the user has to drop his or her hand down into the center portion of the dumbbell to reach and grip the hand grip. U.S. Pat. No. 8,012,069, which is also owned by the assignee of this invention, shows a different loop style handle that may be used with the selectorized dumbbell described above to convert such a dumbbell into a kettlebell configuration. However, given the rectangular or block like nature of the nested weight plates used with the dumbbell shown in the '069 patent, such a converted dumbbell is not generally as comfortable to use as traditional kettlebells since the user has no surface against which his or her forearm can comfortably rest. Accordingly, it would be an advance in the art to provide a selectorized dumbbell having a kettlebell style handle that would be more comfortable to grip and use, but that would still permit easy and quick adjustment of the exercise mass.

SUMMARY OF THE INVENTION

One aspect of this invention relates to a selectorized dumbbell which comprises a handle having a hand grip that is elongated along an axis of elongation and that is long enough to be gripped by one hand of a user. A plurality of add-on weights are also provided in the form of a plurality of hollow housings having generally triangular cross-sectional shapes when taken in a plane perpendicular to the hand grip, the cross-sectional shapes of the housings being sufficiently open and of decreasing size to permit the housings to be nested inside one another. A weight selection mechanism comprises at least one connecting member that is movable into different positions relative to the nested housings to selectively couple a desired number of the housings to the handle for use therewith.

Another aspect of this invention relates to a selectorized dumbbell which comprises a handle assembly that comprises a generally triangularly shaped handle housing having an upwardly extending loop style handle in the manner of a kettlebell handle. The handle housing has angled side walls that provide surfaces on which a user's forearm can rest when doing certain exercises, the handle housing further being hollow inside. A series of generally triangularly shaped add-on weights of progressively decreasing size are provided that can be nested inside one another with the series of weights also being nested inside the handle housing. A selectively repositionable connecting member can be placed into different positions to selectively couple a desired number of the add-on weights to the handle housing.

Yet another aspect of this invention relates to a dumbbell which comprises a housing have at least three sides comprising a top wall and a pair of laterally spaced side walls projecting downwardly from opposite sides of the top wall, wherein at least the side walls comprise substantially flat, planar surfaces. A handle is affixed to and extends upwardly from the top wall of the housing in the manner of a kettlebell style dumbbell, the handle having a hand grip that is elongated along an axis of elongation and that is gripped by a hand of a user from one side of the housing during use of the dumbbell in performing weight training exercises. The hand grip is disposed sufficiently above the top wall such that an adequately sized gap is formed between the top wall and an underside of the hand grip to permit the user to laterally insert the user's gripping hand over the side wall on the one side of the housing and into the gap to thereby grip the hand grip from an underside thereof with the user's gripping hand then being received in the gap. The top wall is sufficiently narrow such that a forearm of the user's gripping hand will extend laterally past the top wall to overlie a portion of the side wall located on the one side of the housing from which the user's gripping hand has gripped the hand grip. The side walls are angled outwardly as they extend downwardly from the top wall of the housing such that the housing has a cross-sectional shape in a plane perpendicular to the axis of elongation of the hand grip in the form of an upright, truncated triangle. The outward angling of the side walls being chosen such that the user's forearm may comfortably rest against the side wall located on the one side of the housing from which the user's gripping hand has gripped the hand grip whenever the user's gripping hand has gripped the underside of the hand grip and an exercise mass provided by the housing and handle has caused the housing to swing or pivot into engagement with the user's forearm.

Still another aspect of this invention relates to a selectorized dumbbell which comprises a handle assembly having a handle housing to which a handle is attached. The handle is elongated along an axis of elongation and is long enough to be gripped by one hand of a user. A plurality of add-on weights are provided in the form of a plurality of hollow housings having generally polygonal cross-sectional shapes when taken in a plane perpendicular to the hand grip. The cross-sectional shapes of the housings are sufficiently open and of decreasing size to permit the housings to be nested inside one another. A weight selection mechanism comprises at least one connecting member that is movable into different positions relative to the nested housings to selectively couple a desired number of the housings to the handle assembly for use therewith. The handle housing is a hollow housing having a generally polygonal cross-sectional shape when taken in a plane perpendicular to the hand grip. The cross-sectional shape of the handle housing is larger than the cross-sectional shape of a largest one of the housings of the add-on weights such that the plurality of add-on weights can all be nested inside the handle housing.

BRIEF DESCRIPTION OF THE DRAWINGS

This invention will be described more fully in the following Detailed Description, when taken in conjunction with the following drawings, in which like reference numerals refer to like elements throughout.

DETAILED DESCRIPTION

Figure 1:
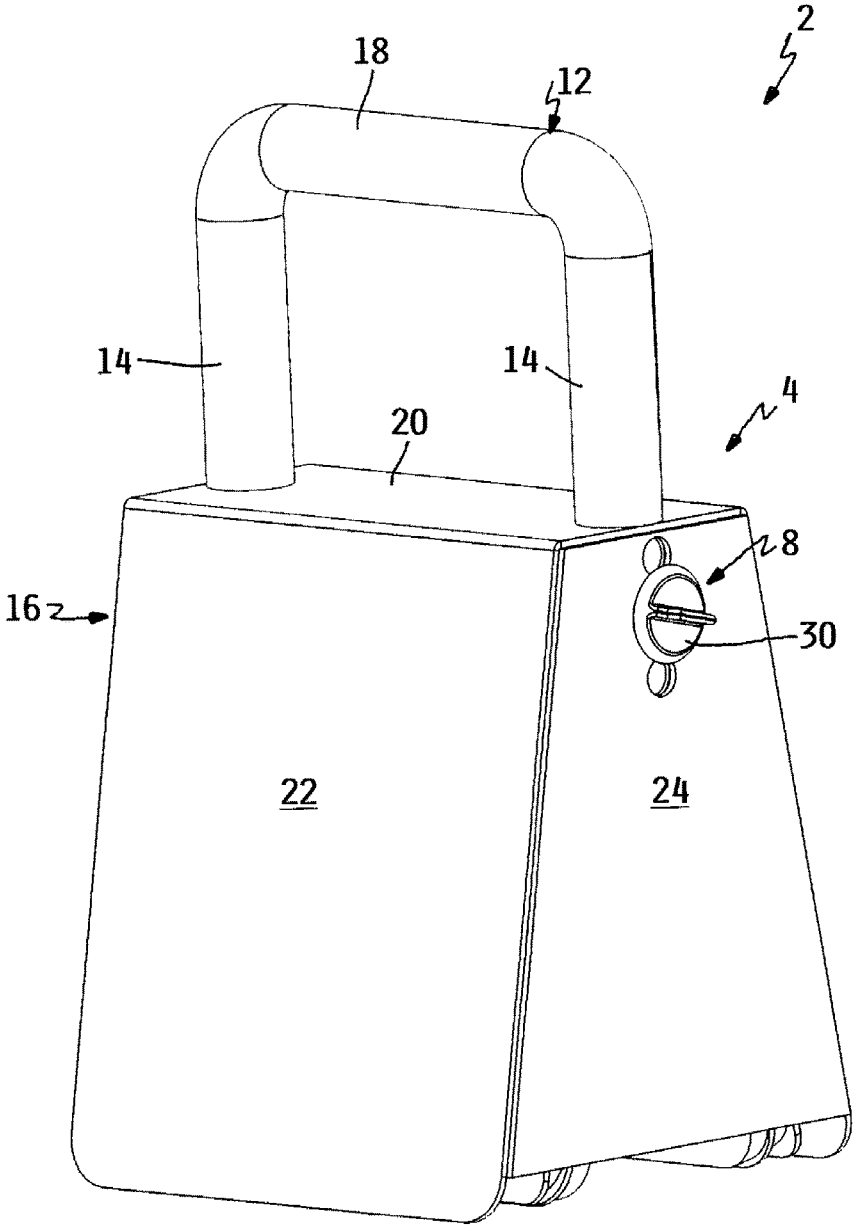
FIG. 1 is a perspective view of one embodiment of a selectorized dumbbell according to this invention.
Figure 2:
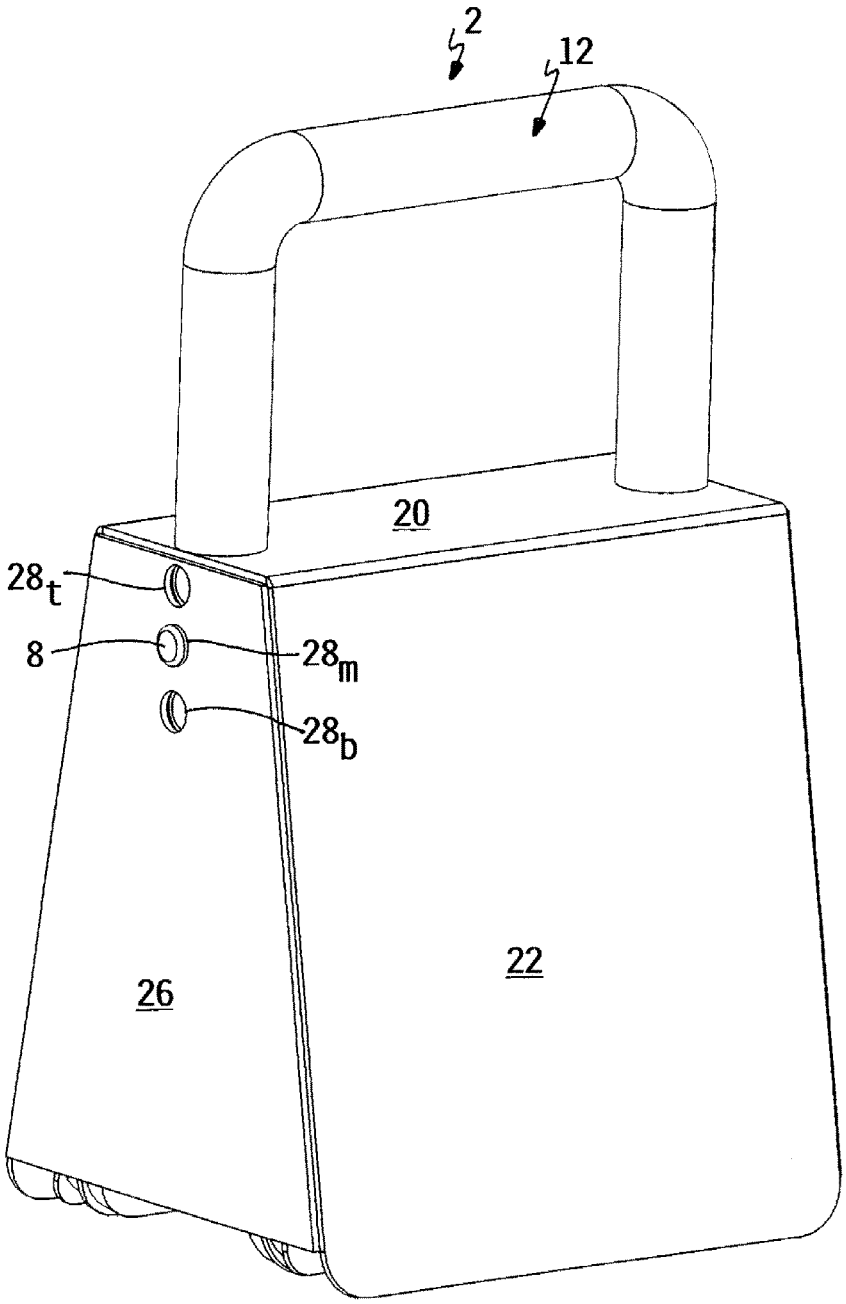
FIG. 2 is a perspective view from a different angle of the dumbbell of FIG. 1.

Referring first to FIGS. 1 and 2, one embodiment of a selectorized dumbbell according to this invention is shown generally as 2. In general terms, dumbbell 2 comprises a handle assembly 4, a plurality of add-on weights 6 that may be selectively attached or coupled to handle assembly 4 in a desired number to vary the total exercise mass provided by dumbbell 2, and a weight selection mechanism that includes a movable connecting pin 8 which is placed into different positions by the user to select how many weights 6 are used in conjunction with handle assembly 4 at any given time. Optionally, dumbbell 2 may also include a cushioned shell 10 that fits around the exterior of a portion of handle assembly 4 to provide convexly shaped rests for the forearm of a user who is using dumbbell 2 to perform weight training exercises. Each of these components of dumbbell 2 will now be described in turn.

Handle assembly 4 includes an upwardly projecting, substantially U-shaped loop handle 12. Handle 12 has a pair of spaced vertical legs 14 whose lower ends are rigidly affixed in any suitable manner to the top of a handle housing 16. The upper ends of legs 14 carry an elongated hand grip 18 therebetween with hand grip 18 being positioned above the top of handle housing 16 by the length of legs 14. Thus, handle 12 is in the style of a kettlebell handle since hand grip 18 is located above handle housing 16 and above the various weights 6 that may be coupled to handle assembly 4. Hand grip 18 is long enough to allow a user to grip and hold hand grip 18 with one hand to be able to use the apparatus of this invention as a dumbbell.

Handle housing 16 forms an exterior enclosure which substantially houses or encloses any or all of weights 6 that are capable of being coupled to handle assembly 4. The overall size of the exterior enclosure provided by handle housing 16 does not change whether only some or all of weights 6 are coupled to handle assembly 4. Thus, dumbbell 2 in use has a substantially uniform, constant size and varies only in how heavy the exercise mass is when the user picks it up. This is an advantage since the relationships of the user's hand and forearm to hand grip 18 and to handle housing 16 remain the same and are unaffected by changes in the exercise mass being provided by dumbbell 2. Thus, if the user's hand and forearm are comfortable for one exercise mass, they will remain comfortable for different exercise masses as the support points for the user's hand on hand grip 18 and for the user's forearm on handle housing 16 remain the same.

Handle housing 16 includes an elongated top wall 20 to which the lower ends of legs 14 of handle 12 are affixed with top wall 20 of handle housing 16 underlying and being parallel to hand grip 18 of handle 12. A pair of angled side walls 22 project downwardly from opposite lateral side edges of top wall 20 with side walls 22 progressively diverging outwardly away from one another as side walls 22 project downwardly. If angled side walls 22 of handle housing 16 had been extended upwardly above top wall 20 of handle housing 16, side walls 22 would have intersected at the vertex of a triangular shape. However, top wall 20 interrupts or cuts off side walls 22 before they can intersect such that handle housing 16 has a truncated triangular cross-sectional shape when the cross-section is taken in a plane perpendicular to the axis of elongation of hand grip 18. Nonetheless, even though the cross-sectional shape is a truncated triangular shape, the cross-sectional shape will be defined herein as a "generally triangular cross-sectional shape". This definition is intended to cover both a fully triangular cross-sectional shape where side walls 22 actually intersect at an actual vertex as well as a truncated triangular cross-sectional shape where side walls 22 intersect only at an imaginary or virtual vertex rather than an actual vertex due to the fact that side walls 22 were cut off or terminated below the virtual vertex by top wall 20.

In addition to top wall 20 and side walls 22, handle housing 16 includes substantially vertical front and back walls 24, 26 that project downwardly from the front and back edges of top wall 20 of handle housing 16. Front and back walls 24, 26 have a height that is substantially the same as the height of side walls 22 and have a triangular shape that substantially matches the "generally triangular cross-sectional shape" of handle housing 16 to substantially fill in or close off the front and back sides of the housing. Thus, the exterior enclosure formed by handle housing 16 is bounded or defined by the horizontal top wall, angled side walls 22, and the vertical front and back walls of handle housing 16, with the bottom of handle housing 16 being open. When handle housing 16 is placed on a horizontal support surface, such as the top of a table or stand, handle housing 16 will be self-supporting on the support surface with the lower edges of angled side walls 22 resting on the support surface and the open bottom of handle housing 16 being immediately adjacent or contiguous to the support surface.

Figure 3:
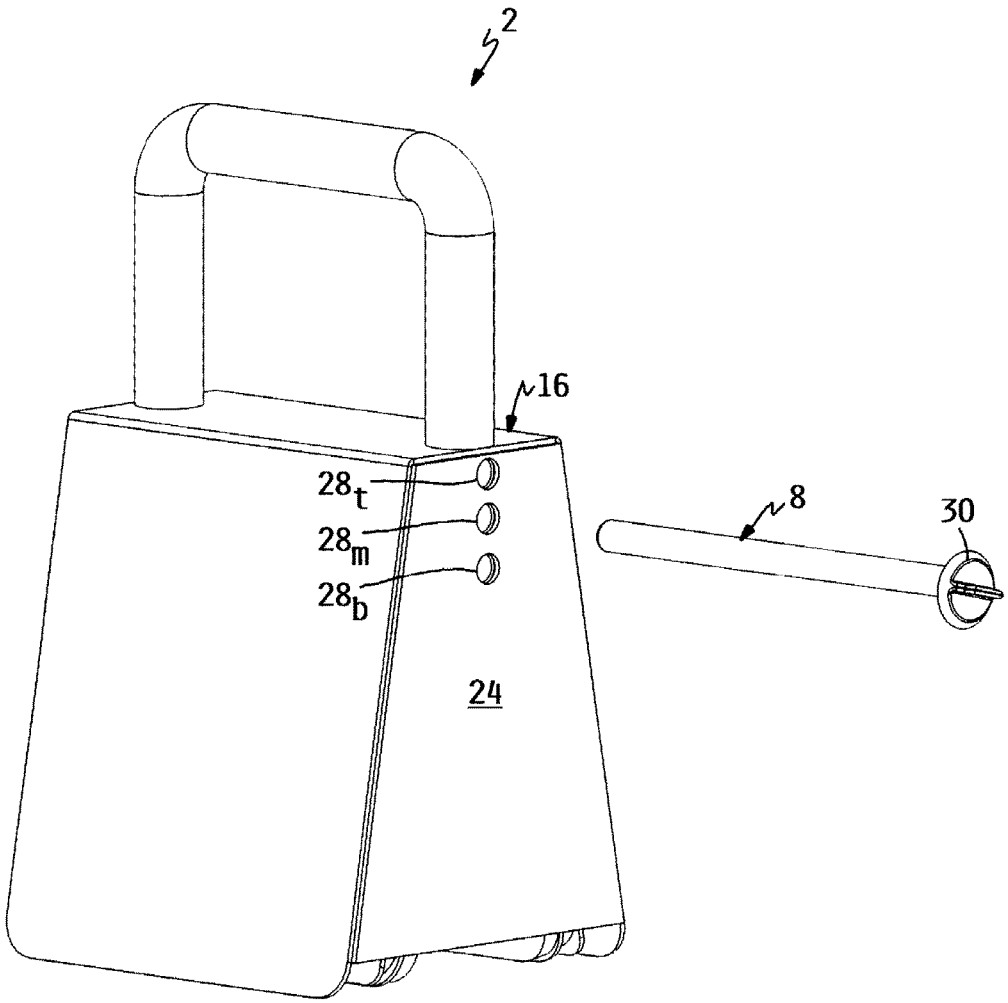
FIG. 3 is a perspective view similar to FIG. 1 of the dumbbell of FIG. 1, particularly illustrating the weight selection mechanism in an exploded form.

Front and back walls 24, 26 of handle housing 16 carry a portion of the weight selection mechanism, namely front and back walls 24, 26 each include an array of vertically spaced holes 28 that begin immediately below top wall 20 and that extend downwardly over a relatively short distance. Three such holes 28 comprising a top hole $\mathbf{28}_t$, a middle hole $\mathbf{28}_m$, and a bottom hole $\mathbf{28}_b$ are shown in FIGS. 1-3. The arrays of holes 28 provided in front and back walls 24, 26 are vertically aligned with one another such that top holes $28_t$ in each of front and back walls 24, 26 are at the same vertical elevation, middle holes $28_m$ in each of front and back walls 24, 26 are at the same but lower vertical elevation, and bottom holes $28_b$ in each of front and back walls 24, 26 are at the same but still lower vertical elevation. While it is preferred that front and back walls 24, 26 be full size walls that extend downwardly over substantially the entire height and laterally over substantially the entire width of handle housing 16, front and back walls 24, 26 could alternatively be in the form of fairly narrow flanges or tabs that extend downwardly and laterally for a distance just long enough to provide a surface in which the arrays of holes 28 could be provided. However, in this flange or tab form of front and back walls 24, 26, the flanges or tabs would have to be thick enough to provide sufficient strength for their intended purpose of forming part of the weight selection mechanism.

Holes 28 are sized to accept another portion of the selection mechanism, namely a selector member which is in the shape of an elongated connecting pin 8 as shown in FIG. 3. Connecting pin 8 has an enlarged magnet containing head 30 which is adapted to abut against one of front and back walls 24, 26 of handle housing 16 after connecting pin 8 has been passed through handle housing 16 with connecting pin 8 being received in one pair of holes 28. The magnetic strength of the magnet (not shown) in head 30 is sufficient to retain connecting pin 8 on one of front and back walls 24, 26, such walls being made of a metallic material, and to prevent connecting pin 8 from being accidentally dislodged during use of dumbbell 2.

Figure 5:
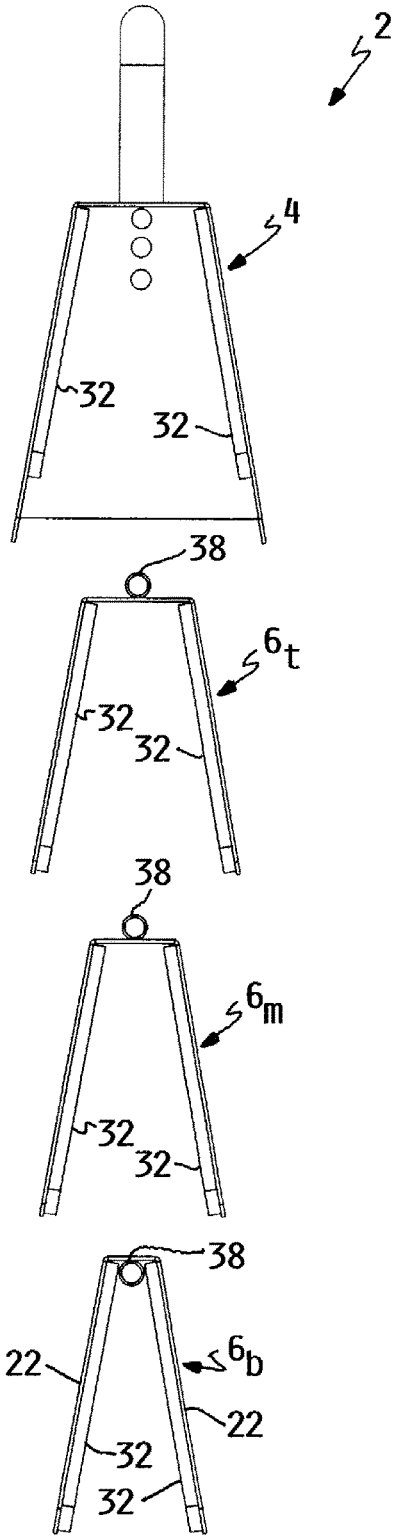
FIG. 5 is an exploded view similar to FIG. 4 but comprising an end elevational view rather than a perspective view.

Preferably, handle housing 16 also doubles as a weights of dumbbell 2 such that a user who lifts just handle housing 16 while gripping and holding hand grip 18 will lift a first increment of weight. This is accomplished by mounting a weight plate 32 to the inside surface of each of side walls 22 of handle housing 16, such as by welding weight plates 32 to side walls 22 since weight plates 32 and side walls 22 are also preferably metallic. Weight plates 32 added to side walls 22 have a length equal to the length of handle housing 16 such that weight plates 32 extend to be closely adjacent front and back walls 24, 26 of handle housing 16 after they are installed on side walls 22. However, weight plates 32 have a shorter height than the height of side walls 22 such that weight plates 32 terminate above the lower edges of side walls 22 by a relatively short distance d as shown in FIG. 5. This is for the purpose of allowing the same weight plates 32 to be used as part of weights 6 that will be described below even though such weights 6 have progressively shorter heights than the height of side walls 22 of handle housing 16.

Figure 6:
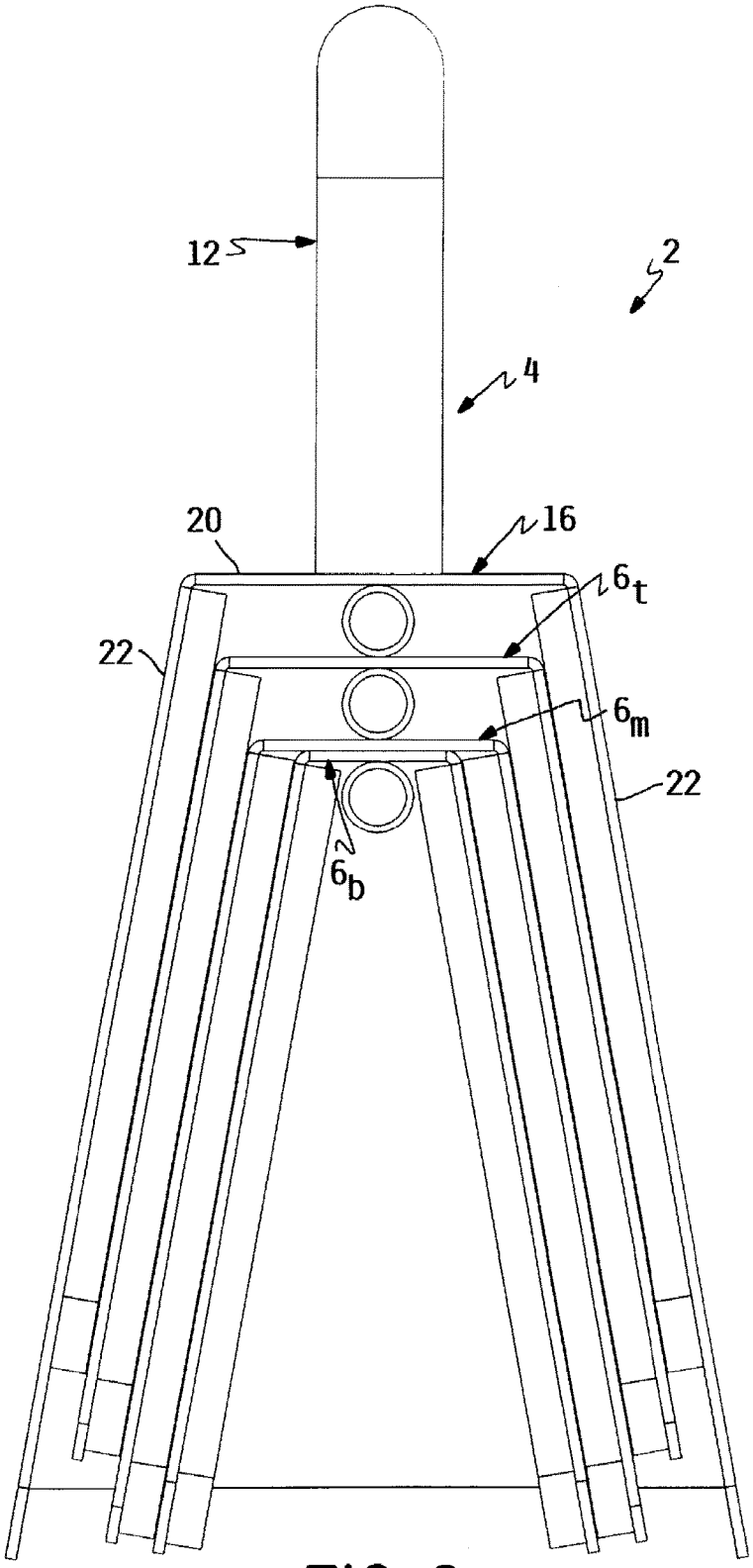
FIG. 6 is an end elevational view similar to FIG. 5, but particularly illustrating the handle assembly and the various add-on weights in a nested rather than exploded form.

Turning now to weights 6 that may additionally be used with handle assembly 4, each weight 6 has a generally triangular cross-sectional shape that mimics the shape of handle assembly 4. However, the generally triangular cross-sectional shapes of weights 6 are progressively smaller such that weights 6 can all be nested inside of one another with the entire set of add-on weights 6 being nested inside of handle housing 16. In the embodiment of dumbbell 2 being described herein, there are three add-on weights 6 comprising a top weight $6_t$, a middle weight $6_m$, and a bottom weight $6_b$. Bottom weight $6_b$ nests inside middle weight $6_m$, these two nested weights $6_m$, $6_b$ then nest inside top weight $6_t$, and then all three nested weights $6_t$, $6_m$, $6_b$ are capable of nesting inside handle housing 16. However, when so nested, weights 6 do not extend below the lower edges of side walls 22 of handle housing 16 such that that handle housing 16 is still self-supporting on a horizontal support surface even when all three weights 6 are nested within handle housing 16. See FIG. 6.

Weights 6, though having the same generally triangular cross-sectional shape of handle housing 16 but in progressively reduced sizes, have a slightly different structure than handle housing 16. Each weight 6 includes a housing that has a top wall 20 and angled side walls 22, but the top wall 20/side wall 22 structure is no longer continuous over the entire length of weight 6. Now, the top wall 20/side wall 22 structure is formed in two separate strap like sections, namely a front section 34 and a back section 36 with there being nothing in between front and back sections 34, 36. Weight plates 32 that add mass to weights 6, preferably comprising the same weight plates 32 as are used in handle housing 16 for part standardization purposes, are now welded to the inside surfaces of side walls 22 provided on front and back sections 34 and 36. Thus, weight plates 32 themselves effectively form complete planar sides walls for weights 6.

Figure 4:
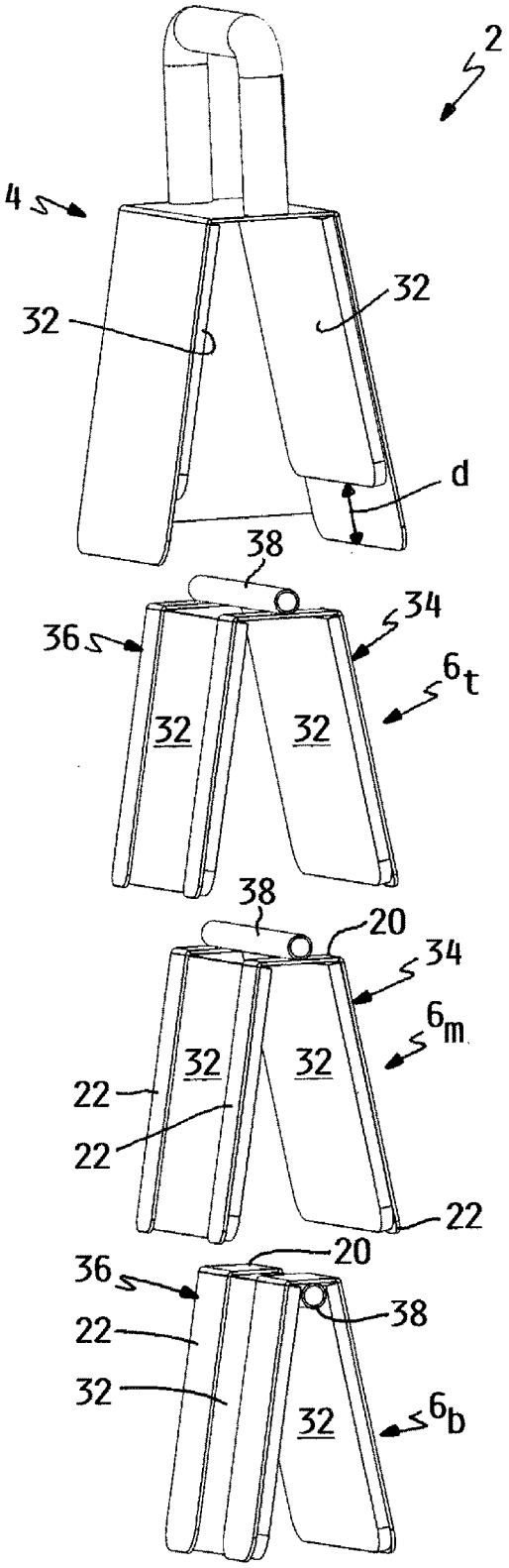
FIG. 4 is a perspective view of the dumbbell of FIG. 1 with the weight selection mechanism and one end wall of the handle assembly having been removed for clarity, particularly illustrating the handle assembly and various add-on weights in exploded form.

Another portion of the weight selection mechanism is placed on each weight 6, namely an elongated, hollow sleeve 38 is welded to top walls 20 of front and back sections 34, 36. In other words, a front end of sleeve 38 is welded to top wall 20 of front section 34 and a back end of sleeve 38 is welded to top wall 20 of back section 36. As best shown in FIGS. 4 and 5, sleeves 38 on top weight $6_t$ and middle weight $6_m$ are welded to the upper surfaces of top walls 20 of front and back sections 34, 36. However, sleeve 38 on bottom weight $6_b$ is welded to the underside of top walls 20 of front and back sections 34, 36 in order that bottom weight $6_b$ take up less vertical space than if sleeve 38 had been welded to the upper surface of top walls 20. This is necessary in order that all three add-on weights $6_t$, $6_m$, $6_b$ nest within handle housing 16 without lifting handle housing 16 up off the support surface on which handle housing 16 rests. See FIG. 6 which shows how handle housing 16 still has the lower edges of side walls 22 thereof resting on the horizontal support surface even with all three weights $6_t$, $6_m$, $6_b$ being nested inside and with all three weights using exactly the same size weight plates 32 as handle housing 16. This would not have been the case had sleeve 38 for bottom weight $6_b$ been welded to the upper sides of top walls 20 since weight plates 32 used on bottom weight $6_b$ would then have protruded somewhat vertically downwardly out through the open bottom of handle housing 16.

If handle housing 16 functions as a weight to provide a first increment of the overall exercise mass of dumbbell 2, e.g. an incremental weight of 5 lbs., then each of weights 6 is designed to provide increments of the same amount, e.g. each add-on weight is designed to also add 5 lbs. to the exercise mass of dumbbell 2. It should be apparent how weights 6 are coupled to handle assembly 4. For example, this can be done by inserting pin 8 through a selected hole $28_t$, $28_m$, or $28_b$ in front wall 24 of handle housing 16 and then passing pin 8 through sleeve 38 on weight 6 that is aligned with such hole $28_t$, $28_m$, or $28_b$ until pin 8 emerges through the same hole $28_t$, $28_m$, or $28_b$ on back wall 26 of handle housing 16 with magnetic head 30 adhering to front wall 24 of handle housing 16. Note that the direction of pin 8 could be reversed if so desired, passing first through back wall 26 of handle housing 16 and exiting through front wall 24 of handle housing 16.

Pin 8 can be is inserted through top hole $28_t$ to selectively couple only top weight $6_t$ to handle assembly 4. Thus, in the example of 5 lb. increments of weight, dumbbell 2 in this configuration would provide a total exercise mass of 10 lbs.

when the user grips hand grip 18 and lifts handle assembly 4 upwardly, e.g. the 5 lbs. provided by handle assembly 4 itself and the 5lbs. provided by top weight $\mathbf{6}_t$. When the user so lifts handle assembly 4, handle assembly 4 and top weight $\mathbf{6}_t$ enclosed inside handle assembly 4 will rise up, leaving the unselected middle and bottom weights $\mathbf{6}_m$, $\mathbf{6}_b$ remaining in a nested stack on the horizontal support surface.

To increase the exercise mass of dumbbell 2 still further, the user then selectively moves pin 8 to one of the lower holes 28 in front and back walls 24, 26 to pass pin 8 through sleeve 38 of either middle weight $\mathbf{6}_m$ or bottom weight $\mathbf{6}_b$. Such an action will positively couple the selected weight to handle assembly 4 as well as any of weights 6 above the selected weight as lifting the selected weight by lifting handle assembly 4 inherently carries with it any of weights 6 above the selected weight. Again, using the 5 lb. incremental weight example above, coupling middle weight $\mathbf{6}_m$ to handle assembly 4 using middle hole $\mathbf{28}_m$ will yield an exercise mass of 15lbs. (as shown in FIGS. 1 and 2) while coupling bottom weight $\mathbf{6}_b$ to handle assembly 4 will yield an exercise mass of 20 lbs. If only handle assembly 4 is used to provide a 5 lb. exercise mass, pin 8 can conveniently stored in one of sleeves 38 of the unused nested weights 6 after handle assembly 4 is lifted off weights 6 to prevent misplacing pin 8. The weight selection mechanism disclosed herein is easy to adjust and provides the user with the ability to quickly change the exercise mass of dumbbell 2 to one of a plurality of different possible values.

Side walls 22 of handle housing 16, and particularly the angles of inclination thereof in relation to the placement of hand grip 18, are designed to provide a surface on which the user may comfortably rest his or her forearm when doing certain exercises. For example, when doing an arm curl using dumbbell 2, the user will grip hand grip 18 from the underside of hand grip 18 with the user's hand being located in the gap or space between top wall 20 of handle housing 16 and hand grip 18 and with the user's forearm extending out over one side wall 22 of handle housing 16. As the user performs an arm curl, the exercise mass of dumbbell 2 will at some point cause handle housing 16 to swing into engagement with the user's forearm and rest against the user's forearm as the user completes the arm curl. However, this is comfortable to do since the angle of side wall 22 is oriented to provide a comfortable forearm rest in this situation. The angles of inclination of side walls 22 of handle housing 16 should preferably be fairly steep with the virtual vertex v of side walls 22 of handle housing 16 being located substantially above hand grip 18.

Figure 7:
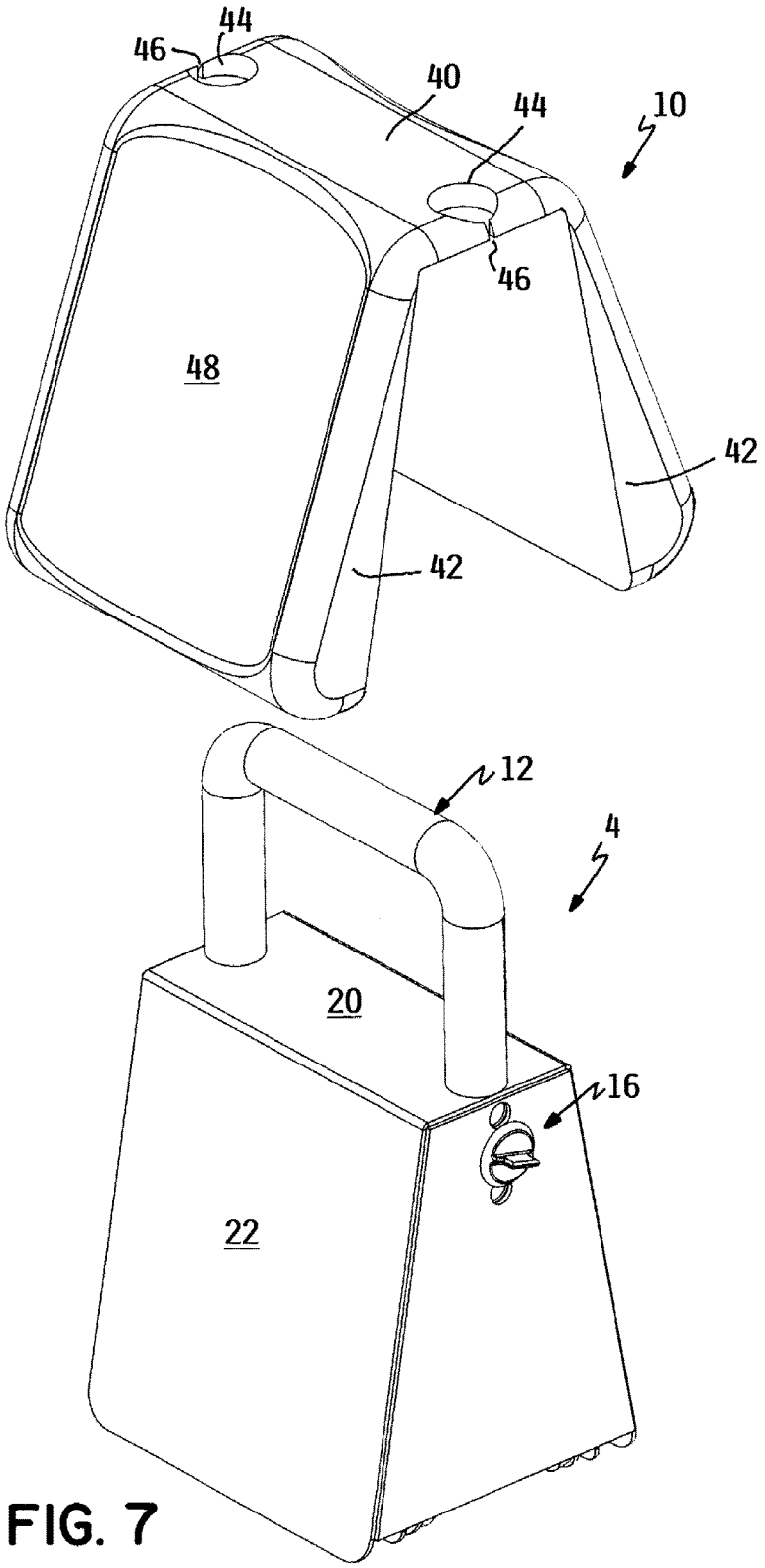
FIG. 7 is a perspective view of the dumbbell of FIG. 1, particularly illustrating a cushioned shell that may be installed on the dumbbell of FIG. 1 to provide softer forearm rests on the opposed side walls of the handle assembly, the shell being shown in exploded form prior to installation of the shell on the dumbbell.
Figure 8:
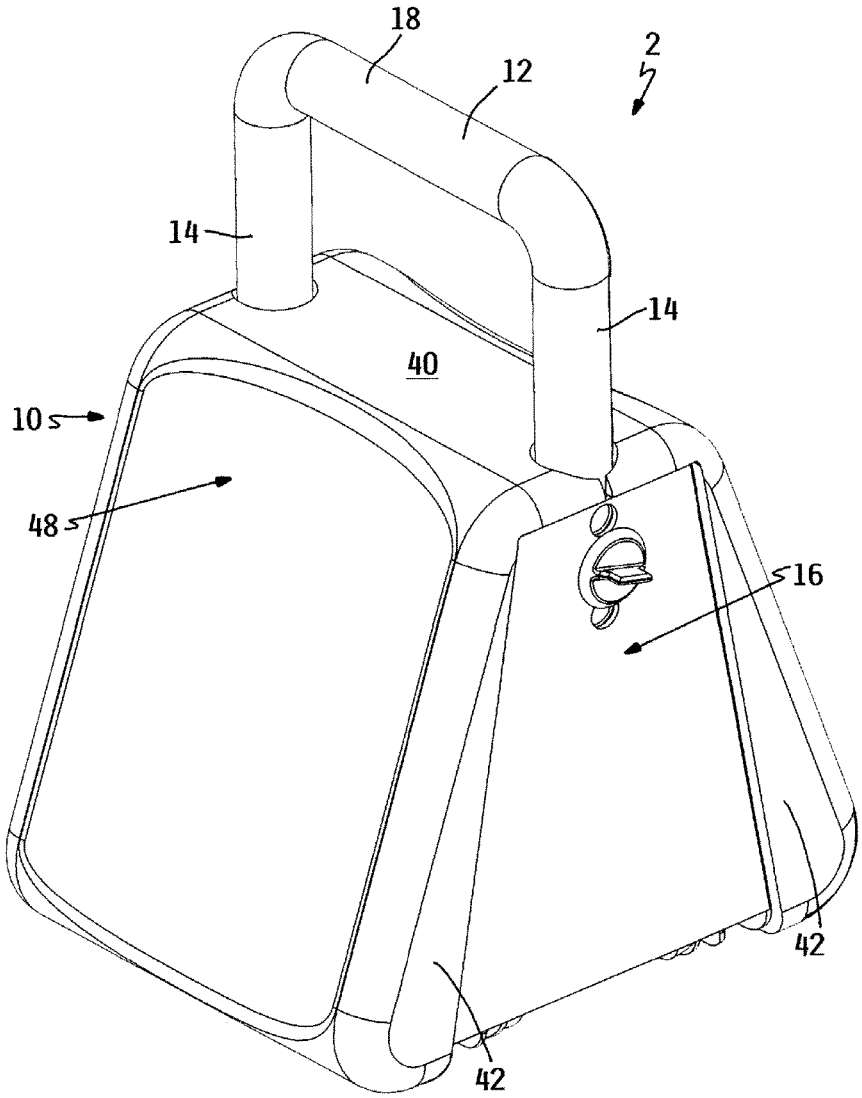
FIG. 8 is a perspective view similar to FIG. 7, but particularly illustrating the shell having been installed on the dumbbell.

Dumbbell 2 as disclosed above could be manufactured, sold and used as has been shown and described with reference to FIGS. 1-6 hereof. However, to further increase the comfort in using dumbbell 2, a cushioned shell 10 made of fairly soft urethane foam could be provided on at least side walls 22 of handle housing 16. Shell 10 could be made in two separate pieces, one for each side wall 22, which pieces could be attached in any suitable manner to side walls 22. Alternatively, as shown in FIGS. 7 and 8, shell 10 could be made as a single piece in the form of a tent shape having an upper ridge 40 and two downwardly angled sides 42 that mimic the exterior shape of handle housing 16. The ridge 40 of tent shaped shell 10 could have various holes 44 and slits 46 providing access to holes 44 therein to allow shell 10 to be installed on handle housing 16 by suitable flexing and squeezing of shell 10 into place with slits 46 opening up to allow holes 44 to be received around legs 14 of loop handle 12 of handle assembly 4. In either case, sides 42 of shell 10, namely that portion of shell 10 covering side walls 22 of handle housing 16, preferably have shallow convexly shaped grooves 48 into which a user's forearm can be received in those instances where one side wall 22 of handle housing 16 swings into engagement with the user's forearm. Use of shell 10 would be even more comfortable than simply having the user's forearm rest on side wall 22 itself. However, use of shell 10 is optional and could be dispensed with if so desired.

Various modifications of this invention will be apparent to those skilled in the art. For example, handle assembly 4 with its loop style handle 12 and its handle housing 16 with angled side walls 22 could be provided in different weights as a set of kettlebells without using any add-on weights 6 or weight selection mechanism disclosed above. While such a set of handle housings 16 would lack the ease of weight adjustability of that of the preferred embodiment, such housings would still feature the easily manufactured shape of angled side walls 22 which would provide comfortable forearm rests.

In addition, the cross-sectional shapes of handle housing 16 and of the housings of add-on weights 6 taken in a plane perpendicular to the axis of elongation of hand grip 18 could be other types of polygonal shapes and are not limited to the generally triangular shape of the preferred embodiment. For example, if side walls 22 of handle housing 16 and side walls 22 of each weight 6 were to extend vertically straight downwardly from top walls 20 rather than being angled outwardly as they extend downwardly from top walls 20, then the cross-sectional shape would be a generally rectangular cross-sectional shape. As in the preferred embodiment, all of the generally rectangular cross-sectional shapes beginning with that of handle housing 16 and continuing with those of the series of weights 6 would be of progressively decreased size to allow the series of weights 6 to all be nested within or inside of one another and any/or all of the weights 6 further being nested within or inside of handle housing 16.

While such a generally rectangular cross-sectional shape would not itself be as comfortable on a user's forearm as would be the generally triangular shape of the preferred embodiment, this could be overcome by use of shell 10. Shell 10 would have an open cross-sectional configuration in the interior that would fit snugly around the generally rectangular cross-sectional shape of the side walls 22 and top wall 20 of handle housing 16. However, the exterior side surfaces of shell 10 would then be molded or formed into the generally triangular cross-sectional shape that is more comfortable on the user's forearm, with such side surfaces of shell 10 optionally continuing the use of convex grooves 48 as well. The net result would be a dumbbell having the easy nesting and easy adjustment of that of the preferred embodiment, but also having comfortable forearm rests of the type disclosed in the preferred embodiment since the exterior sides of shell 10 would look the same as in FIGS. 7 and 8, even though a generally rectangular cross-sectional housing shape was used in handle housing 16 and in weights 6 instead of a generally triangular cross-sectional housing shape.

Accordingly, the scope of this invention is to be limited only the appended claims.

The invention claimed is:

1. A selectorized dumbbell, which comprises:

a handle assembly that comprises a generally triangularly shaped handle housing having an upwardly extending loop style handle in the manner of a kettlebell handle, the handle housing having angled side walls that provide surfaces on which a user's forearm can rest when doing certain exercises, the handle housing further having opposite end walls that are spaced apart from one another by a predetermined length, wherein each end wall has an array of vertically spaced holes therein with the holes in the hole array in one end wall being vertically aligned with the holes in the hole array in the other end wall to form corresponding hole pairs in the end walls that are at different vertical elevations relative to one another, the handle housing further being hollow inside;

a series of generally triangularly shaped add-on weights nested inside the handle housing, wherein each add-on weight has an elongated, peripherally enclosed bore having open ends, wherein the bore is formed by a surface of the add-on weight which surface extends in a substantially continuous and unbroken manner over both a central portion of the predetermined length between the end walls and a majority of the predetermined length between the end walls, and wherein the bores in the add-on weights each align with a different corresponding hole pair in the end walls when the add-on weights are nested inside the handle housing; and a selectively repositionable connecting member that can be inserted through any given corresponding hole pair in the end walls and through the bore of whichever add-on weight has the bore thereof vertically aligned with the given corresponding hole pair to selectively couple a desired number of the add-on weights to the handle housing, the number of add-on weights that are coupled to the handle housing depending upon which corresponding hole pair and bore receive the connecting member.

2. The dumbbell of claim 1, wherein the angled side walls of the handle housing are covered by cushioned members that provide convexly shaped rests for the user's forearm.

3. The dumbbell of claim 2, wherein the cushioned members are made from urethane foam.

4. The dumbbell of claim 1, wherein the bore in each add-on weight comprises an open-ended, hollow, cylindrical sleeve affixed to each add-on weight with the bore forming surface comprising an inner diameter of the sleeve.

5. The dumbbell of claim 1, wherein the side walls and end walls of the handle housing have substantially the same vertical height and are joined to each other in a manner that forms a four-sided enclosure.

* * * * *